United States Patent [19]

Melocik

[11] 4,392,415

[45] Jul. 12, 1983

[54] CONTROL FOR DEAD ENGINE LOWER

[75] Inventor: Kurt B. Melocik, Mazon, Ill.

[73] Assignee: Caterpillar Tractor Co., Peoria, Ill.

[21] Appl. No.: 273,889

[22] PCT Filed: Dec. 19, 1980

[86] PCT No.: PCT/US80/01704

§ 371 Date: Dec. 19, 1980

§ 102(e) Date: Dec. 19, 1980

[87] PCT Pub. No.: WO82/02230

PCT Pub. Date: Jul. 8, 1982

[51] Int. Cl.[3] ..... F16K 31/122

[52] U.S. Cl. ..... 91/461; 137/625.63

[58] Field of Search ..... 91/436, 437, 438, 441, 91/450, 451, 461; 137/625.63

[56] References Cited

U.S. PATENT DOCUMENTS

| | | | |
|---|---|---|---|
| 3,568,718 | 3/1971 | Wilke | 137/625.6 |
| 3,805,678 | 4/1974 | Bianchetta et al. | 91/447 |
| 3,840,049 | 10/1974 | Field, Jr. | 137/625.63 |
| 3,862,643 | 1/1975 | Dezelan et al. | 137/625.63 |
| 3,987,703 | 10/1976 | Latimer | 91/6 |

*Primary Examiner*—George L. Walton

*Attorney, Agent, or Firm*—J. W. Burrows

[57] ABSTRACT

A mechanism (80) is provided to controllably lower an actuator (28) upon the loss of a source (62) of pilot fluid in a fluid system requiring a float condition of operation. A resolver (80) is located in a vent line of a make-up valve and is connected to a second load supporting end (32) of the actuator (28) and is controllably vented to a tank (38) by moving a pilot control valve (48) to a fourth position (D). This eliminates the need to provide complicated systems having pilot operated check valves which are more difficult to control.

2 Claims, 1 Drawing Figure

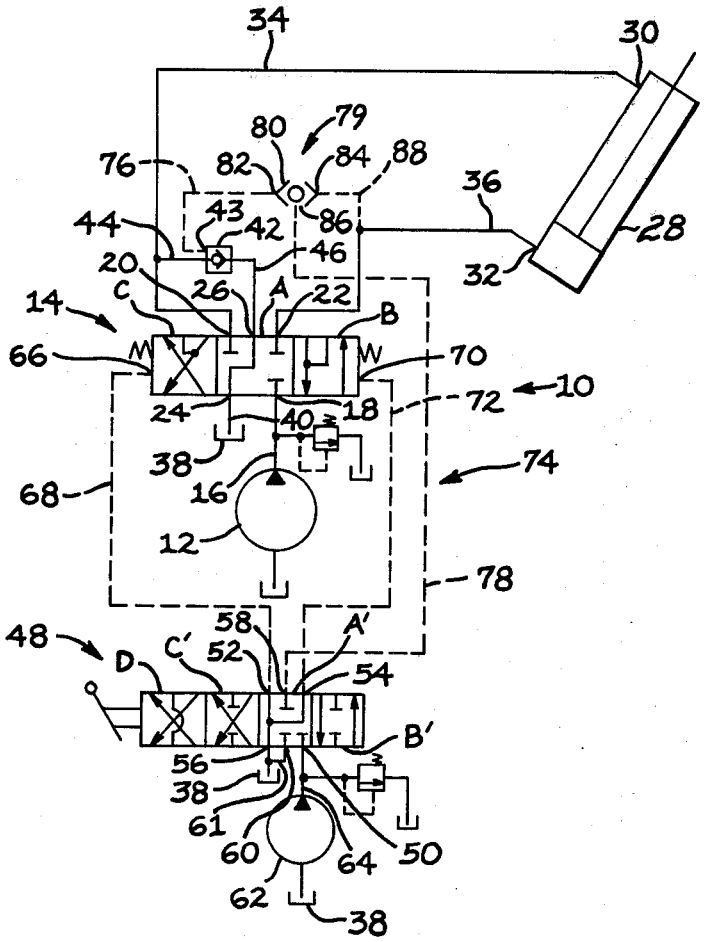
34
30
79
80
76
82
84
88
36
44
43
42
86
28
46
20
32
C
26
A
22
14
B
66
M
W
70
10
24
40
18
72
38
74
68
16
12
78
48
58
A'
D
C'
52
54
B'
56
38
61
60
64
50
62
38

CONTROL FOR DEAD ENGINE LOWER

TECHNICAL FIELD

This invention is directed to pilot operated control valve systems and particularly to those requiring a float condition plus a controlled lowering of a raised load upon loss of pilot pressure.

BACKGROUND ART

Some systems use a signal obtained from the load supporting end of an actuator to supply pressure to the pilot valve in response to the failure of the engine. However these systems do not provide a float condition of operation. Other systems use a make-up valve which can be vented and thus opened to allow fluid to be passed to tank from a load supporting end of an actuator upon failure of the engine. However these systems do not provide an accurate control of the load during lowering because the check in the make-up may not respond quickly enough due to large amounts of fluid flowing therethrough.

A system, such as that in the U.S. Pat. No. 3,840,049 issued to Jesse L. Field, Jr. on Oct. 8, 1974 and assigned to the assignee of the present invention, teaches a system having a float condition and a mechanism for providing a lowering of a load under dead engine conditions, but this system also requires venting behind the make-up and having to control the degree of opening of the make-up during lowering. The system is also more complex in that it requires two different make-up valves and a selector valve responsive to pilot pressure to provide both float and dead engine lower.

The present invention is directed to overcoming one or more of the problems as set forth above.

DISCLOSURE OF THE INVENTION

In one aspect of the invention, a fluid system has a fluid source, a tank and an actuator. The actuator has a first end and a second load supporting end. A pilot operated control valve having first and second ends is connected to the source and the actuator. A pilot control valve is connected to a source of pilot fluid and the first and second ends of the pilot operated control valve and movable between at least one operating position and a float position. A make-up valve is connected between the first end of the actuator and the pilot operated control valve and has a vent line connected to the make-up valve and the pilot control valve. The vent line is in communication with the tank at the float position of the pilot control valve. A means communicates the second load supporting end of the actuator to the tank through the vent line and the pilot control valve in response to loss of the source of pilot fluid and the pilot control valve being moved to the float position.

BRIEF DESCRIPTION OF THE DRAWINGS

The FIGURE is a schematic of an embodiment of the present invention.

BEST MODE FOR CARRYING OUT THE INVENTION

Referring now to the FIGURE, a fluid system is generally indicated by reference numeral 10 and includes a fluid source, such as, a pump 12 and a pilot operated control valve 14 connected to the pump 12 by conduit 16. The pilot operated control valve 14 has an inlet port 18 connected to the conduit 16, first and second outlet ports 20,22, an exhaust port 24 and a vent port 26. The pilot operated control valve is movable between first, second and third positions "A", "B" and "C". At the first position "A", the inlet port 18 is blocked from communication with the first and second outlet ports 20,22; the first and second outlet ports 20,22 are blocked from the exhaust port 24; and the vent port 26 is in communication with the exhaust port 24. At the second position "B", the inlet port 18 is in communication with the second outlet port 22, and the first outlet port 20 and the vent port 26 are in communication with the exhaust port 24. At the third position "C", the inlet port 18 is in communication with the first outlet port 20, and the second outlet port 22 and the vent port 26 are in communication with the exhaust port 24.

An actuator 28 having a first end 30 and a second load supporting end 32 is connected to the first and second outlet ports 20,22 of the pilot operated control valve 14, via conduits 34,36 respectively.

A tank 38 is connected to exhaust port 24 of the pilot operated control valve 24 via a conduit 40. A make-up valve 42 having a vent passage 43 is connected to conduit 34 and vent port 26 of the pilot operated control valve 14 via conduits 44,46 respectively.

A pilot control valve 48 has a pilot inlet port 50, first and second pilot outlet ports 52,54, a pilot exhaust port 56, a pilot vent port 58, and an exhaust vent port 60. The exhaust vent port 60 is connected to tank 38 by a conduit 61. The pilot inlet port 50 is connected to a source of pilot fluid such as a pilot pump 62 via a conduit 64. The first pilot outlet port 52 is connected to a first end 66 of the pilot operated control valve 14 via a conduit 68 and the second pilot outlet port 54 is connected to the second end 70 of pilot operated control valve 14 via a conduit 72.

The pilot control valve is movable between first, second, third and fourth positions "A'", "B'", "C'", "D". At the first position "A'", the first and second pilot outlet ports 52,54 are blocked from communication with the pilot inlet port 50 and in communication with the pilot exhaust port 56 and the pilot vent port 58 is blocked from communication with the exhaust vent port 60. At the second position "B'", the second pilot outlet port 54 is in communication with the pilot inlet port 50, the first pilot outlet port 52 is in communication with the pilot exhaust port 56 and the pilot vent port 58 is blocked from the exhaust vent port 60. At the third position "C'", the first pilot outlet port 52 is in communication with the pilot inlet port 50, the second pilot outlet port 54 is in communication with the pilot exhaust port 56 and the pilot vent port 58 is blocked from communication with the exhaust vent port 60. At the fourth or float position "D", the first pilot outlet port 52 is in communication with the pilot inlet port 50, the second pilot outlet port 54 is in communication with pilot exhaust port 56 and pilot vent port 58 is in communication with the exhaust vent port 60.

A vent line 74, consisting of first and second conduits 76,78 is connected to the vent passage 43 of the make-up valve 42 and the pilot vent port 58 of pilot control valve 48.

A means 79 for communication the second load supporting end 32 of the actuator 28 to the tank 38 through the vent line 74 and the pilot control valve 48 is located in the vent line 74. The means 79 includes a resolver valve 80 having a first inlet port 82 connected to the first conduit 76, a second inlet port 84 connected to the second supporting end 32 by the conduit 36 and a third conduit 88, and an outlet port 86 connected to a second conduit 78.

INDUSTRIAL APPLICABILITY

The present invention has particular utility in hydraulic systems that require a float condition during normal operation and lowering of a suspended load upon failure of the pilot source, such as loss of engine power.

To raise the load, an operator moves pilot control valve 48 to the second position "B'" directing pilot fluid to the second end 70 of pilot operated control valve 14, shifting the pilot operated control valve 14 to the second position "B" thus directing fluid flow to the second load supporting end 32 of actuator 28. The flow from the first end 30 returns to the tank 38 via conduit 34 and pilot operated control valve 14. To lower the load, the pilot control valve 48 is moved to the third position "C'" causing the pilot operated control valve 14 to shift to the third position "C" thus directing fluid flow from the pump 12 to the first end 30 of actuator 28 and exhausting fluid from the second load supporting end 32 to tank 38 across the pilot operated control valve 14. By moving the pilot control valve 48 to the fourth position "D", the actuator 28 will be placed in a "float" condition. That is, the first end 30, the second load supporting end 32 and the pump 12 are simultaneously communicated to tank 38 thus allowing unrestricted movement of actuator 28. In the float position "D" of the pilot control valve 48, the pilot operated control valve 14 is held in the third position "C" and the vent passage 43 of make-up valve 42 is communicated with tank 38 through the vent line 74, pilot vent port 58, exhaust vent port 60, and conduit 61. By venting the make-up valve 42, the make-up valve 42 opens, allowing the first end 30 of the actuator 28 and the pump 12 to communicate with tank 38 through make-up valve 42 and vent port 26 and exhaust port 24 of pilot operated control valve 14 at the third position "C".

In the event that actuator 28 is extended and the pilot pump 62 fails or the vehicle engine stops, the pilot operated control valve 14 automatically returns to the first position "A" which blocks the first and second outlet ports 20,22 from the tank 38. By moving the pilot control valve 48 to the float position "D" the fluid in the second load supporting end is controllably passed to tank 38 via conduit 36, third conduit 88, resolver 80, second conduit 78 of vent line 74, pilot vent port 58 and exhaust vent port 60 of pilot control valve 48, and conduit 61.

With the addition of the resolver 80 and the third conduit 88, the suspended load can be controllably lowered through the pilot control valve 48 in the event a loss of the pilot pump occurs while still maintaining a system requiring a float condition under normal operations.

Other aspects, objects and advantages of this invention can be obtained from a study of the drawing, disclosure and appended claims.

I claim:

1. In a fluid system (10) having a fluid source (12), a tank (38), an actuator (28) having a first end (30) and a second load supporting end (32); a pilot operated control valve (14) having first and second ends (66,70) and being connected to said source (12) and said actuator (28); a source of pilot fluid (62); a pilot control valve (48) connected to said source of pilot fluid (62) and said first and second ends (66,70) of the pilot operated control valve (14) and movable between at least one operating position and a float position; a make-up valve (42) connected between the first end (30) of the actuator (28) and the main control valve (14), a vent line (74) connected to the make-up valve (42) and the pilot control valve (48) and being in communication with the tank (38) at the float position (D) of the pilot control valve (62); the improvement comprising:

means (79) for communicating the second load supporting end (32) of the actuator (28) to the tank (38) only through said vent line (74) and said pilot control valve (48) in response to loss of said source of pilot fluid (62) and said pilot control valve (48) being moved to said float position (D) so that the second load supporting end (32) can be vented to the tank (38) at a controlled rate regardless of the pressure of the fluid in the second load supporting end.

2. In a fluid system (10) having a fluid source (12), a tank (38), an actuator (28) having a first end (30) and a second load supporting end (32); a pilot operated control valve (14) having first and second ends (66,70) and being connected to said source (12) and said actuator (28); a source of pilot fluid (62); a pilot control valve (48) connected to said source of pilot fluid (62) and said first and second ends (66,70) of the pilot operated control valve (14) and movable between at least one operating position and a float position; a make-up valve (42) connected between the first end (30) of the actuator (28) and the main control valve (14), a vent line (74) connected to the make-up valve (42) and the pilot control valve (48) and being in communication with the tank (38) at the float position (D) of the pilot control valve (62), said vent line (74) includes first and second conduits (76,78), said first conduit (76) being connected to said make-up valve (42) and said second circuit (78) being connected to said pilot control valve (48); the improvement comprising;

a resolver valve (80) and a third conduit (88) adapted to communicate the second load supporting end (32) of the actuator (28) to the tank (38) through said vent line (74) and said pilot control valve (48) in response to loss of said source of pilot fluid (62) and said pilot control valve (48) being moved to said float position (D), said third conduit (88) being connected to said second load supporting end (32) and said resolver valve (80) being located in said vent line (74) between said first and second conduits (76,78) and having a first inlet port (82) connected to said first conduit (76), a second inlet port (84) connected to said third conduit (88) and an outlet port (86) connected to said second conduit (78).

* * * * *